US005820675A

United States Patent [19]

Madrzak

[11] Patent Number: 5,820,675

[45] Date of Patent: Oct. 13, 1998

[54] APPLICATION UNIT FOR DIRECTLY OR INDIRECTLY APPLYING A FLUID OR PASTY MEDIUM TO A CONTINUOUS MATERIAL WEB

[75] Inventor: Zygmunt Madrzak, Heidenheim, Germany

[73] Assignee: Voith Sulzer Papiermaschinen GmbH, Germany

[21] Appl. No.: 774,397

[22] Filed: Dec. 30, 1996

[30] Foreign Application Priority Data

Dec. 29, 1995 [DE] Germany ..... 295 20 686.1

[51] Int. Cl.[6] ..... B05C 5/00

[52] U.S. Cl. ..... 118/410; 118/413; 118/419; 118/602; 118/610; 118/123; 118/126

[58] Field of Search ..... 118/123, 126, 118/410, 413, 419, 602, 610, 261; 427/355, 356

[56] References Cited

U.S. PATENT DOCUMENTS 4,340,011 7/1982 Wahren et al. .
4,495,888 1/1985 Wöhrle et al. .
4,594,963 6/1986 Krautzberger ..... 118/410
4,880,671 11/1989 Sollinger et al. .
5,436,030 7/1995 Damrau ..... 118/410

FOREIGN PATENT DOCUMENTS

0536649A1 4/1993 European Pat. Off. .
3446757 5/1986 Germany .

*Primary Examiner*—Laura Edwards
*Attorney, Agent, or Firm*—Ostrolenk, Faber, Gerb & Soffen, LLP

[57] ABSTRACT

An application unit for directly or indirectly applying a fluid or pasty medium to a continuous material web, particularly one made of paper or cardboard, includes a beam that extends across the entire length of the application unit, and a distribution pipe arranged within beam. The pipe is connected via through-flow openings to a feed duct merging into a metering gap forming a free-jet nozzle. The pipe may alternatively be coupled to an application chamber. The through-flow openings are arranged in an upper portion of the distribution pipe and at least one discharge opening for fluid or pasty medium is provided at any one or more other portions of the distribution pipe.

16 Claims, 3 Drawing Sheets

APPLICATION UNIT FOR DIRECTLY OR INDIRECTLY APPLYING A FLUID OR PASTY MEDIUM TO A CONTINUOUS MATERIAL WEB

BACKGROUND OF THE INVENTION

1. Field of the Invention

The invention relates to an application unit for applying a fluid or pasty medium to a continuous material web, particularly paper or cardboard.

2. Related Art

An application unit for applying a fluid or pasty medium to a material web is known from DE 34 46 757 Al. This unit comprises a beam extending across the entire length of the application unit and a distribution pipe arranged within the beam which is connected via through-flow openings in a lower area of the distribution pipe to a chamber extending circumferentially around the distribution pipe and continuing into an elongated feed duct leading to a slot-shaped outlet. The fluid or pasty medium fed into the distribution pipe flows out of the distribution pipe via the through-flow openings, reaches the annular chamber, and then passes through the feed duct to a slot-shaped outlet from which it is ejected into an application chamber limited by the material web and a blade member.

Application units for directly or indirectly applying a fluid or pasty medium to a continuous material web, particularly paper or cardboard, are also known. Such units comprise a beam extending across the entire length of the application unit and a distribution pipe, arranged within the beam, connected via through-flow openings to a feed duct merging into a metering gap designed as a free-jet nozzle. The free-jet nozzle is formed between a leading-side lip and a trailing-side lip. If the fluid or pasty medium is directly applied, a material web usually runs past the free-jet nozzle and the free jet of fluid or pasty medium is directly applied thereto. The material web may for example be guided on the surface of a roll. If the medium is indirectly applied, the material from the free jet is first applied to a carrier face, e.g. the surface of an application roll. The carrier face is disposed within a roll gap through which the material web passes and the material web thus receives the material from the application roll. The leading-side lip lies on the side of the metering gap from which the application roll or material web arrives. The trailing-side lip lies on that side of the metering gap from which the application roll or material web departs. The leading-side lip may have a concavely curved deflection surface for deflecting the free jet.

With regard to application units having through-flow openings that connect the interior of the distribution pipe to the feed duct located at an upper portion of the distribution pipe, it has been found that dead zones are formed in the lower interior region of the distribution pipe where the fluid or pasty medium silts up and the cross section of the distribution pipe becomes clogged with sediment over time. Thus, the pipe interior is reduced in size which adversely affects the running of the application unit. If the undesired sediment becomes dislodged during ongoing operation and is carried with the normal flow of fluid or pasty medium to the material web it causes the finished product to exhibit a considerably diminished quality. Finally, it has also been found that it is frequently disadvantageous for these through-flow openings to be located too close to the application site. Indeed, various pressure conditions throughout the length of the distribution pipe, for example at the end faces where the-medium is usually fed, make it extremely difficult to supply the medium in an even manner that is beneficial for an even line.

For these reasons, in a great many application-unit designs, the through-flow openings are usually arranged at a lower portion of the distribution pipe so that silting up and undesired sediment can be avoided at this site. This known embodiment however, has the disadvantage that the fluid or pasty medium must cover a long flow path from the through-flow openings to the application site which is very far away. Due to the high viscosity of the fluid or pasty medium and the resultant high friction losses, very high pressures and pump capacities are necessary to move the material to the free-jet nozzle. This has an adverse effect on the application unit's energy consumption. The high pressures and long flow paths also make it necessary for those parts of the application unit that form the feed duct to have an extremely solid and complex design. Outlay in terms of materials and production is then correspondingly high.

SUMMARY OF THE INVENTION

An object of the invention is to provide a simple and effective application unit which can be used not only to achieve a top-quality application with as little energy consumption of the application unit as possible, but simultaneously to effectively prevent the distribution pipe from clogging up in an undesirable and disadvantageous manner.

This and other objects are met using an application unit according to the invention.

According to the invention, the through-flow openings are arranged in an upper portion of the distribution pipe and one or more discharge openings for the fluid or pasty medium are provided at any one or more other portions of the distribution pipe. The discharge openings are, however, preferably arranged at a lower portion of the distribution pipe.

The application unit according to the invention makes it possible to produce a high-quality application in an advantageous, simple and effective manner, since the distribution pipe is effectively prevented from clogging up and the formation of undesired sediment in the distribution pipe is avoided. At the same time, the through-flow openings that connect the inside of the distribution pipe to the feed duct can be placed into an upper portion of the distribution pipe and, hence, may be located in direct proximity to the application site. Thus, a very short flow path of the fluid or pasty medium from the through-flow openings to the application site is obtained and only minimum friction and flow losses arise. Compared to conventional designs, the application unit according to the invention can consequently be operated at lower pressures and pump capacities and, therefore, exhibits reduced energy consumption. Consequently, the various application-unit components can be designed to be smaller, more compact, lighter and more simple. Because silting up and the formation of sediment is effectively prevented, periods of stoppage caused by maintenance and cleaning work that is normally necessary in this regard can also be considerably reduced. Further, the direct vicinity of the through-flow openings to the application site and the feed duct's correspondingly compact design, the application unit according to the invention can be surprisingly used to achieve an even distribution of the fluid or pasty medium and a very even line. For the above reasons, the application unit according to the invention can be inexpensively manufactured and run economically while permitting a top-quality final product to be produced.

It has proved to be beneficial to design the total cross-sectional passage area of the discharge openings to be much smaller than that of the through-flow openings. In this way, only insignificant pressure losses are experienced when some of the fluid or pasty medium flows off through the distribution pipe's discharge openings. Thus, the fluid or pasty medium's passage through the through-flow openings and feed duct, toward the application site, is not negatively affected. At the same time, the departing flow of fluid or pasty medium produced through the discharge openings is sufficient to effectively prevent silting up or the formation of sediment within the distribution pipe's lower portion.

According to another advantageous embodiment of the invention, the size of the discharge openings' cross-sectional passage area is adjustable and/or sealable. For this purpose, variously designed stubpipes, nozzles, inserts, sliding devices, adjusting mechanisms, sealing members and the like may be utilized in accordance with the invention. To avoid the aforementioned silting up and formation of sediment, the discharge openings can be adapted to the flow conditions of the fluid or pasty medium and to whatever application-unit component geometries are relevant.

A further advantageous embodiment of the application unit according to the invention comprises at least one circulating device that directly or indirectly returns, as part of a cycle, the fluid or pasty medium emerging from the discharge openings back to the distribution pipe. This circulating device comprises all the equipment needed for the purpose of circulation, such as trapping devices, collecting devices, pressure generating devices, conveying devices, shut-off devices, connection members, valves, filters, conduits, control and/or regulating device and the like. Recycling the fluid or pasty medium that has emerged from the discharge openings back to the working process makes it possible to avoid unnecessary loss of material and to minimize the consumption of the particular medium used. This has a particularly positive effect on operating and production costs.

It has also proved advantageous for the invention to have the leading-side lip or trailing-side lip securely connected to a feed-duct wall, which wall can be pivoted around a joint so that, by folding down the wall, the feed duct is easily accessible for cleaning or maintenance purposes. The arrangement of the through-flow openings according to the invention and the resultant short flow paths allow the pivotable wall to be very simply and compactly designed and to be inexpensively produced.

In a further advantageous embodiment of the invention, the pivotable wall is fitted with a pressing apparatus which presses the pivotable wall (with the leading-side lip or trailing-side lip securely attached thereto) toward the respective opposite lip. This feature can be used to vary or adjust the feed-duct geometry and the metering gap. Depending on the type of pressing apparatus used, the adjustment may take place manually and/or automatically during or after the application unit's ongoing operation. Thus, for example, various influence factors may be coordinated with the fluid or pasty medium used to enable the application unit to be optimally adapted to changing conditions especially during ongoing operation, which avoids fairly long, cost-intensive periods of stoppage.

The pressing apparatus preferably comprises a lever mechanism securely connected to the pivotable wall and is directly or indirectly supported at the application unit's beam. The joint of the pivotable wall preferably serves as a center of rotation and the wall itself acts as part of the lever mechanism, thus making a compact multifunctional design possible. Directly or indirectly supporting the pressing apparatus at the beam of the application unit enables the forces arising during the pressing operation to be introduced into the application-unit structure in a manner that is favorable in terms of structural design, thus avoiding a large design.

Although the lever mechanism can, in principle, be implemented by means of a single, sufficiently stable lever which comprises the pivotable wall, it has been shown to be particularly advantageous for the lever mechanism to comprise several lever strips distributed across the length of the application unit. Preferably, each lever strip is attached, at one end, to the pivotable wall and, at the other end, to a connecting member that connects the individual lever strips together. The lever mechanism can therefore be produced with a minimum material outlay resulting in low weight, which both simplifies manual handling and permits a reduction in the setting and/or adjusting mechanisms used to vary the pivotable wall. Because the lever strips are distributed over the length of the application unit, the leverage forces are introduced in a particularly even manner onto the pivotable wall, thus permitting precise adjustment.

Preferred exemplary embodiments of the invention that highlight additional design details and advantages will be further described and explained by reference to the attached drawings.

DETAILED DESCRIPTION OF THE PREFERRED EMBODIMENTS

To avoid repetition, similar parts and components will, in the following description and figures, be identified by the same reference symbols, unless further differentiation is required.

Figure 1:
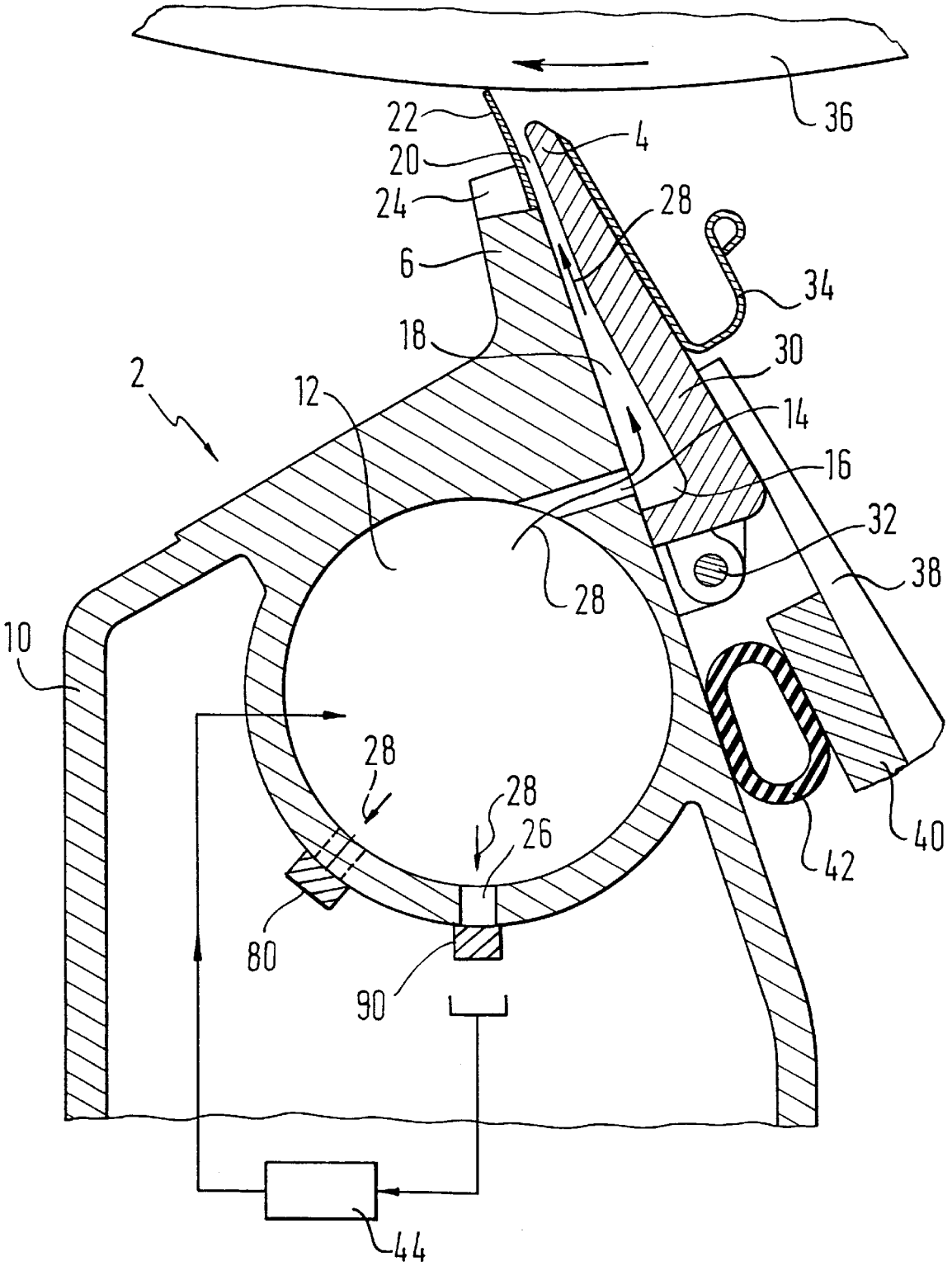
FIG. 1 shows a schematic cross-sectional representation of a first exemplary embodiment of the application unit according to the invention.

As can be seen in FIG. 1 as part of a schematic cross-sectional representation, a first exemplary embodiment of application unit 2 according to the invention is shown in its operating setting. The application unit 2 comprises a beam 10 that extends across the entire length of application unit 2. A distribution pipe 12, which is also usually designated as a color distribution pipe, is formed in beam 10 for a fluid or pasty medium 28 (indicated by arrows) to be applied. In an upper portion of distribution pipe 12, through-flow openings 14 located at about the 1-o'clock position connect distribution pipe 12 to an equalizing chamber 16 which continues in a feed duct 18. Discharge bores 26 for the fluid or pasty medium 28 are also provided in a lower portion of distribution pipe 12, roughly at the 6-o'clock position. Discharge bores 26.2 can also be made available at any other portion of distribution pipe 12 end may replace discharge bores 26. Such additional discharge bores 26.2 are indicated in FIG. 1 by hatched lines at about an 8-o'clock position. Through-flow openings 14 and discharge bores 26 or 26.2 are to be dimensioned such that the aggregate passage area of all discharge openings 26 or 26.2 is substantially smaller than the total passage area of through-flow openings 14.

The size of the openings 26, 26.2 is adjustable by way of an adjusting mechanism 80. Thus, the openings 26, 26.2 may be adapted to the flow conditions of the particular type of fluid 28 in use. The openings 26, 26.2 may also be sealed via seal 90.

The aforementioned feed duct 18 merges into a metering gap 20 formed between a leading-side lip 4 and a trailing-side lip 6. A blade member 22, such as a knife or a roll blade, is fixed within a mount 24. The blade member 22 serves as an application blade and is arranged at the free end of trailing-side lip 6. A front wall 30 has one side which forms a wall of feed duct 18 and which is securely connected to leading-side lip 4. The front wall 30 is either rigidly fixed or pivotable to a certain extent (about joint 32) for adjustment purposes. If necessary, the wall 30 can also be folded down around a joint 32, for instance for cleaning or maintenance purposes. An overflow channel 34 for excess fluid or pasty medium 28 is provided at the leading side of front wall 30.

It is further evident from FIG. 1 that pivotable front wall 30 is fitted with a pressing apparatus that presses front wall 30 and leading-side lip 4 toward opposite trailing-side lip 6. In the present exemplary embodiment, the pressing apparatus comprises a lever mechanism securely connected to pivotable front wall 30 and having a plurality of lever strips 38 distributed across the length of the application unit 2. The strips 38 are each attached, at one end, to front wall 30 and, at the other end, to a connecting profile 40 that connects individual lever strips 38 together. A total of ten lever strips 38 is preferably used in the present exemplary embodiment. A pressure hose 42 is arranged between the connecting profile 40 and an outer surface of beam 10. If pressure hose 42 is activated, the resultant deformation of pressure hose 42 causes a leverage force to be introduced into the lever mechanism via connecting profile 40. Thus, pivotable front wall 30 and adjoining leading-side lip 4 moves in the above-described manner, whereby joint 32 acts as a center of rotation (or pivot) and the lever mechanism is supported at beam 10 via pressure hose 42.

As can be easily identified in FIG. 1, this embodiment of application unit 2 permits feed duct 18 to have a very short design and for pivotable front wall 30 (which comprises leading-side lip 4) and lever mechanism 38, 40 to be designed very compactly.

An application roll 36 for indirectly applying the medium 28 is located opposite application unit 2. The direction of rotation of application roll 36 is shown by an arrow. As is evident from the drawing, leading-side lip 4 lies on the side of metering gap 20 from which application roll 36 arrives, while trailing-side lip 6 lies on the opposite side of metering gap 20, i.e., the side from which application roll 36 departs.

In this embodiment of the invention, fluid or pasty medium 28 flows from color distribution pipe 12, through equalizing chamber 16 (via through-flow openings 14) and through feed duct 18 to metering gap 20. Medium 28 emerges from metering gap 20 in a free jet (not illustrated) and encounters rotating application roll 36. To adjust a predetermined cross section, the applied fluid or pasty medium 28 is then scraped off by means of blade member 22.

Since the interior of distribution pipe 12 is at a high pressure during the operation of application unit 2, a small amount of fluid or pasty medium 28 also emerges from distribution pipe 12 because discharge openings 26 or 26.2 are a relatively small compared to through-flow openings 14. A circulation device, which is generally characterized in FIG. 1 by reference numeral 44, directly or indirectly returns, as part of a cycle, the emerged fluid or pasty medium 28 to distribution pipe 12. Circulation device 44 comprises all the equipment to perform such circulation. The equipment may include trapping devices, collecting devices, pressure generating devices, conveying devices, shutoff devices, connection members, valves, filters, conduits, control and/or regulating devices and the like. These devices and systems are known and, therefore, are not depicted in the drawing for the sake of clarity.

Discharge bores 26.2 which are arranged at an 8-o'clock position during operation are particularly advantageous. This is so because during a stoppage, the application unit 2 is pivoted from the operating position shown in FIG. 1 into a servicing or cleaning position where discharge bores 26.2 are moved to approximately a 6-o'clock position. Thus, any residual fluid or pasty medium 28 remaining inside the distribution pipe 12 may run off easily.

Figure 2:
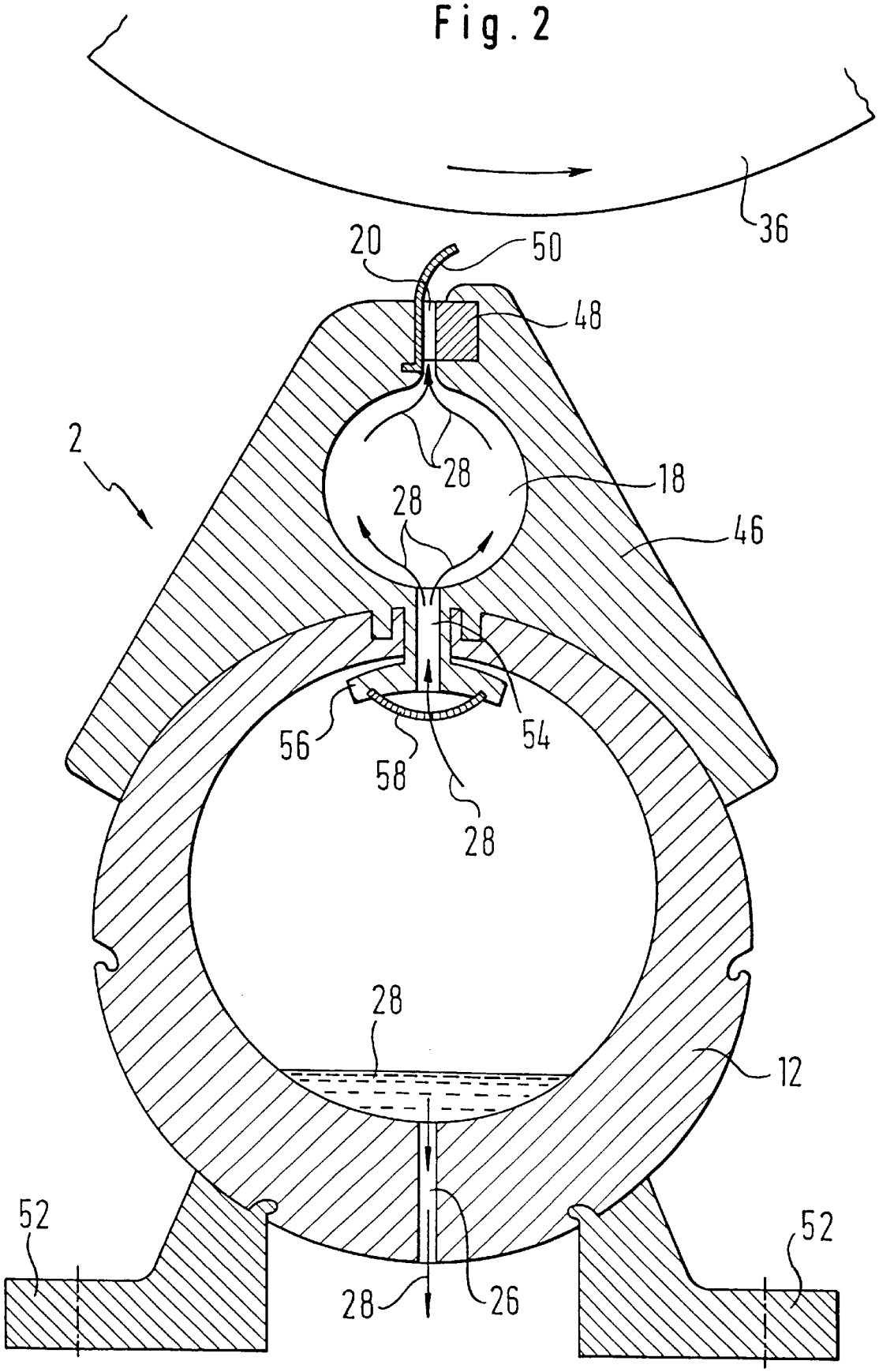
FIG. 2 shows a schematic cross-sectional representation of a second exemplary embodiment of the application unit according to the invention.

A second exemplary embodiment of the invention is shown in FIG. 2 as part of a schematic cross-sectional representation. This version has a mount 46 that tapers toward application roll 36 and is adapted to include a specially designed profile strip 48. The profile strip 48 comprises a plurality of metering gaps 20 to which a concave deflection surface 50 adjoins. Mount 46 is directly fitted and fixed to distribution pipe 12 which is formed as a supporting body of application unit 2. The underside of mount 46 is adapted to the geometry of distribution pipe 12. Distribution pipe 12 preferably has a wall thickness that tapers (or reduces) from its lower to upper portions. The pipe 12 is fixed to a commercially available support member 52.

Mount 46 is integrally formed and connected to distribution pipe 12 via a slot 54 located at about the 12-o'clock position. The slot 54 serves as a through-flow opening within the pipe, with the result that an anchor-like attachment portion 56 of mount 46 projects inside the distribution pipe 12. Mount 46 contains a feed duct 18, the lower end of which merges via through-flow opening 54 into distribution pipe 12 and the upper end of which merges into profile strip 48 (acting as free-jet nozzles). A large-surface filter member 58 is provided at an inlet opening of feed duct 18. One or more discharge openings 26 for fluid or pasty medium 28 are provided at about the 6-o'clock position in the lower portion of distribution pipe 12. As can be easily identified in the drawing, medium 28 which accumulates in the base area of distribution pipe 12 (for example, when the application unit is stopped) flows out through discharge openings 26.

Figure 3:
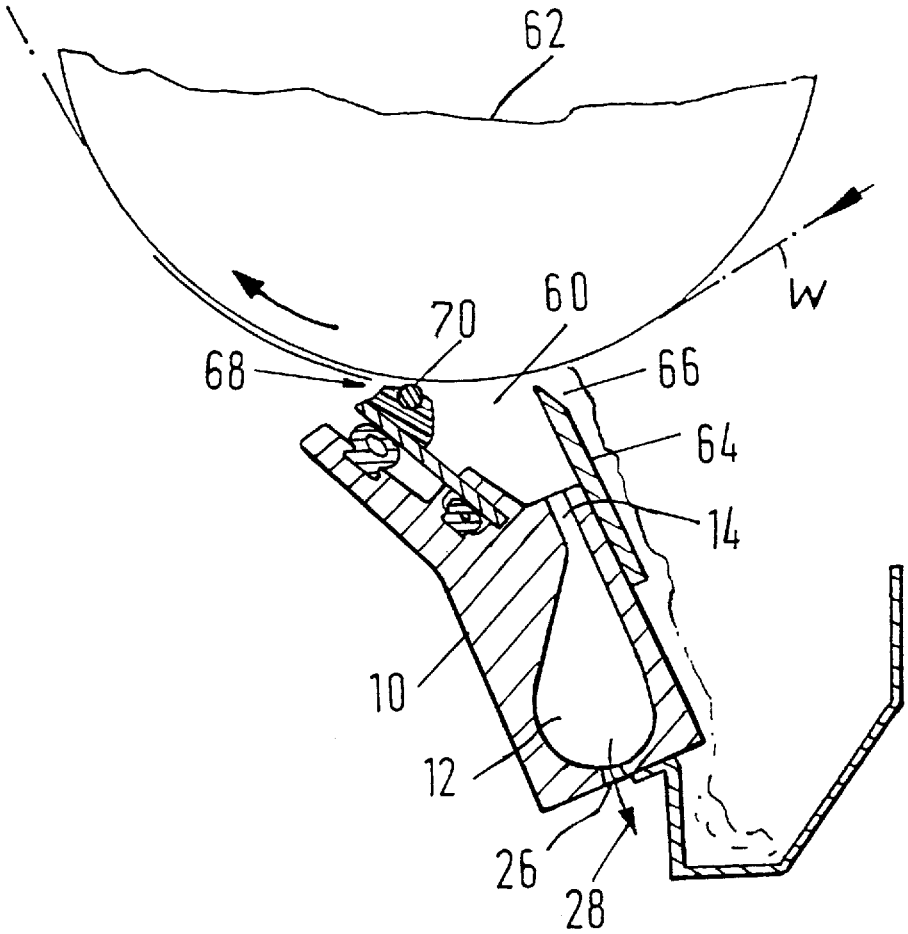
FIG. 3 shows a schematic cross-sectional representation of a third exemplary embodiment of the application unit according to the invention.

A third exemplary embodiment of the invention is shown in cross section in FIG. 3 and may be used as a pre-metering device within a coating system which directly coats a material web. This pre-metering device also comprises a beam 10 extending across the entire length of the pre-metering device and a distribution pipe 12 arranged within beam 10. The distribution pipe 12 merges into an application chamber 60 via through-flow openings 14, arranged in its upper portion, where the openings 14 simultaneously form a feed duct. The material web characterized in FIG. 3 by the reference symbol W is guided in the area of application chamber 60 and over a counter roll 62 which partially loops around it. Fluid or pasty medium 28 is laterally fed into distribution pipe 12 and reaches application chamber 60 via openings 14 where it is applied to the continuous material web W. A leading-side gap 66 is formed at the leading-side end of application chamber 60 by a flow-restrictor plate 64. A trailing-side gap 68 is formed at the trailing-side end by means of a roll blade bar 70. As is also apparent from FIG. 3, a plurality of discharge openings 26 for fluid or pasty medium 28 is provided in a lower portion of distribution pipe 12.

The invention is not restricted to the aforementioned examples which merely depict preferred embodiments. On the contrary, depending on the particular use, the application unit according to the invention may differ considerably from the exemplary embodiments. Depending on the application, suitable positions other than those described may be selected for the discharge bores or discharge openings. Depending on the given flow conditions in the distribution pipe, it is also possible to close discharge openings 26 and/or 26.2 completely or in part during ongoing operation, only to reopen them during a period of rest. Instead of the fluid or pasty medium's emergence through the discharge openings, it is also conceivable to guide additional fluid or pasty medium in a pressurized manner through the "discharge openings" into the interior of the distribution pipe so as to achieve an effect comparable to when the medium flows out, with the additionally introduced medium being thoroughly mixed and agitated in the distribution pipe's base area. This likewise prevents silting up or the formation of sediment. To adjust front wall 30, it is also possible to use devices other than the aforementioned, purely mechanical mechanism. For example, thermal, hydraulic, pneumatic, electrical, electromagnetic, magnetic, magnetostrictive, piezoelectric adjustment devices etc. and combinations thereof are conceivable.

Reference symbols in the claims, specification and drawings merely help the reader to understand the invention better and are not intended to restrict the scope of protection.

List Of Reference Symbols

The following are designated:

2 Application unit
4 Lip, leading side
6 Lip, trailing side
10 Beam
12 Distribution pipe/color distribution pipe
14 Through-flow openings
16 Equalizing chamber
18 Feed duct
20 Metering gap
22 Blade member
24 Mount for 22
26 Discharge bores
28 Fluid or pasty medium
30 Front wall
32 Joint
34 Overflow channel
36 Application roll
38 Lever strips
40 Connecting profile
42 Pressure hose
44 Circulating means
46 Mount
48 Profile strip
50 Concave deflection surface
52 Supporting member
54 Slot
56 Attachment portion
58 Filter member
60 Application chamber
62 Counter roll
64 Flow-restrictor plate
66 Leading-side gap
68 Trailing-side gap
70 Roll blade bar
W Material web

What is claimed is:

1. An application unit for applying a fluid to a continuous material web, comprising:

a beam extending lengthwise;

a metering gap coupled to said beam and including a leading-side lip and an oppositely disposed trailing-side lip forming a free-jet nozzle;

a distribution pipe arranged within said beam and having an upper portion, said distribution pipe including at least one through-flow opening for said fluid disposed in said upper portion and at least one discharge opening for said fluid disposed in any other portion;

a feed duct communicating, at one end, with said through-flow opening and, at another end, with said metering gap such that said fluid is flowable substantially directly from said distribution pipe to said feed duct through said through-flow opening.

2. The application unit according to claim 1, wherein said discharge openings are arranged at a lower portion of said distribution pipe.

3. The application unit according to claim 1, wherein the size of said discharge opening is smaller than that of said through-flow opening.

4. The application unit according to claim 1, wherein the size of said discharge opening is adjustable.

5. The application unit according to claim 1, wherein said discharge opening is sealable.

6. The application unit according to claim 1, further comprising at least one circulator for returning said fluid emerging from said discharge opening to said distribution pipe.

7. The application unit according to claim 1, wherein one of said leading-side lip and trailing-side lip is securely connected to a wall of said feed duct and said feed duct is pivotable about a joint.

8. The application unit according to claim 7, further comprising a pressing apparatus operatively coupled to said pivotable wall such that one of said leading-side lip and trailing-side lip may be pressed toward the other.

9. The application unit according to claim 8, wherein said pressing apparatus comprises a lever mechanism securely connected to said pivotable wall and is one of directly and indirectly supported at said beam.

10. The application unit according to claim 9, wherein said lever mechanism comprises a plurality of lever strips distributed across the length of said application unit, each strip being secured, at one end, to said pivotable wall and, at another end, to a connecting member that connects said individual lever strips together.

11. An application unit for applying a fluid to a continuous material web, comprising:

a mount including an application chamber and at least one metering gap, said application chamber communicating with said metering gap;

a distribution pipe coupled to said mount and having an upper portion, said distribution pipe including at least one through-flow opening for said fluid disposed in said upper portion and at least one discharge opening for said fluid disposed in any other portion;

said through-flow opening coupling said distribution pipe with said application chamber such that said fluid is flowable substantially directly from said distribution pipe to said application chamber through said through-flow opening.

12. The application unit according to claim 11, wherein said discharge openings are arranged at a lower portion of said distribution pipe.

13. The application unit according to claim 11, wherein the size of said discharge opening is smaller than that of said through-flow opening.

14. The application unit according to claim 11, wherein the size of said discharge opening is adjustable.

15. The application unit according to claim 11, wherein said discharge opening is sealable.

16. The application unit according to claim 11, further comprising at least one circulator for returning said fluid emerging from said discharge opening to said distribution pipe.

* * * * *